United States Patent [19]

Burrows et al.

[11] Patent Number: 4,511,366

[45] Date of Patent: Apr. 16, 1985

[54] LIQUID FUELS AND CONCENTRATES CONTAINING CORROSION INHIBITORS

[75] Inventors: Aubrey L. Burrows, Bracknell; Paul B. Mabley, Hampton Hill; Steven J. Field, Wokingham, all of England

[73] Assignee: Ethyl Petroleum Additives, Inc., Bracknell, England

[21] Appl. No.: 562,276

[22] Filed: Dec. 16, 1983

[51] Int. Cl.[3] ..... C10L 1/18

[52] U.S. Cl. ..... 44/53; 44/56; 44/62; 44/66; 44/63; 44/71; 252/392

[58] Field of Search ..... 44/71, 53, 56, 63, 62, 44/66; 252/392

[56] References Cited

U.S. PATENT DOCUMENTS

| | | | |
|---|---|---|---|
| 2,490,744 | 12/1949 | Trigg et al. | 252/392 |
| 2,622,018 | 12/1952 | White et al. | 44/66 UX |
| 2,632,695 | 3/1953 | Landis et al. | 44/66 |
| 2,638,449 | 5/1953 | White et al. | 44/66 |
| 2,941,943 | 6/1960 | Kirkpatrick et al. | 252/392 |
| 2,948,598 | 8/1960 | Brehm | 44/66 |
| 3,304,162 | 2/1967 | Marvel, Jr. | 44/71 |
| 3,468,639 | 9/1969 | Lindstrom et al. | 44/63 |
| 4,010,111 | 3/1977 | Chappell et al. | 252/392 |
| 4,207,077 | 6/1980 | Bove et al. | 44/53 |
| 4,214,876 | 7/1980 | Garth | 44/66 |
| 4,305,730 | 12/1981 | Davis et al. | 44/66 |
| 4,426,208 | 1/1984 | Perilstein | 44/56 |

*Primary Examiner*—Y. Harris-Smith

*Attorney, Agent, or Firm*—Donald L. Johnson; John F. Sieberth; W. G. Montgomery

[57] ABSTRACT

Corrosion caused by gasohol or alcohol motor fuels is inhibited by the addition of a corrosion inhibiting amount of the combination of (A) a polymer of a $C_{18}$ polyunsaturated aliphatic monocarboxylic acid (e.g. linoleic dimer and/or trimer) and (B) the reaction product of (i) a polyalkylene polyamine, (ii) a $C_{18}$ monounsaturated aliphatic monocarboxylic acid (e.g. oleic acid), and (iii) an alkenyl succinic anhydride, in which the alkenyl group contains 8 to 30 carbon atoms.

18 Claims, No Drawings

LIQUID FUELS AND CONCENTRATES CONTAINING CORROSION INHIBITORS

BACKGROUND

In the past metal corrosion caused by conventional motor fuels such as gasoline was not much of a problem because such hydrocarbon fuels are inherently non-corrosive. However, with the advent of fuels containing alcohols such as gasohol or straight alcohol fuels, corrosion has become a major problem because such fuels are corrosive. It has been reported that this corrosion is due to the presence of acidic contaminants in fuels such as formic acid. It is almost impossible to avoid such contaminants because they occur in fuel grade alcohols and are also formed in storage as normal alcohol oxidation products.

SUMMARY

It is known from U.S. Pat. No. 4,305,730 polymerized linoleic acid, especially trimer, is an effective corrosion inhibitor for alcohol-type motor fuels. It has now been discovered that the corrosion inhibiting properties of such polymerized polyunsaturated aliphatic monocarboxylic acids are improved by use of the co-additive described herein.

DESCRIPTION OF PREFERRED EMBODIMENTS

According to the present invention, metal corrosion caused by alcohol-type motor fuels is inhibited by adding to the fuel a combination of (A) polymerized polyunsaturated aliphatic monocarboxylic acid and (B) the reaction product of a polyalkylenepolyamine, a monounsaturated aliphatic monocarboxylic acid and, optionally, an alkenyl succinic anhydride.

Specifically, the invention provides a liquid fuel adapted for use in an internal combustion engine said fuel comprising from 5 to 100 weight percent alcohol, from 0 to 95 weight percent gasoline and a corrosion inhibiting amount of a combination of (A) a polymer of one or more $C_{16}$ to $C_{18}$, preferably a mainly $C_{18}$ polyunsaturated aliphatic monocarboxylic acids and (B) a reaction product of (i) about one mole part of one or more polyalkylene polyamines having the formula $H_2N\text{-}(\text{-}RNH)_n\text{-}H$ wherein n is an integer from 1 to about 8 the average value of n in a mixture of such polyamines preferably being from 2 to 5, and R is a divalent hydrocarbon group containing 2 to 4 carbon atoms, (ii) about 0.1 to 5 mole parts of one or more $C_{10}$ to $C_{20}$, eg. a mainly $C_{18}$ monounsaturated aliphatic monocarboxylic acids or lower alkyl esters thereof and (iii) 0 to about 4 mole parts of an alkenyl succinic anhydride wherein the alkyl group contains about 8–30 carbon atoms.

The 'combination' may be a simple mixture or as explained further hereafter, components A and B may react together.

The additive combination is useful in any alcohol-type motor fuel including gasoline-alcohol mixtures (e.g. "gasohol") as well as straight-alcohol type fuels. Useful alcohols include methanol, ethanol, n-propanol, isopropanol, isobutanol and the like including alcohol mixtures. Gasohol usually contains about 2 to 30 volume percent alcohol. At concentrations above 10 volume percent phase separation is a problem especially in the presence of water which is difficult to avoid. Phase separation can be minimized by including other oxygenates as co-solvents such as ethers, ketones, esters and the like. An especially useful co-solvent is methyl tert-butyl ether (MTBE) which also increases octane value.

The additive combination may be used at a concentration which provides the required amount of corrosion protection. A useful range is about 1 to 5000 p.p.m. A more preferred range is about 5 to 2000 p.p.m. and the most preferred concentration is 10 to 500 p.p.m.

Component A is a polymer of a polyunsaturated aliphatic monocarboxylic acid chiefly consisting of $C_{18}$ acid units. Examples of these are linoleic acid and linolenic acid including mixtures thereof. The polymers comprise mainly dimers and trimers of the polyunsaturated acids. Suitable polymers of linoleic acid are available commercially. Mixtures high in trimer content are most preferred.

Component B is a reaction product of two or three reactants.

The first reactant is a polyalkylene polyamine. These compounds have the structure $H_2N\text{-}(\text{-}R\text{—}NH)_n\text{-}H$ in which n is an integer from 1–8 preferably with an average value in mixtures of about 2–5. R is a divalent hydrocarbon group containing 2–4 carbon atoms. Examples of these reactants are ethylene diamine, diethylene triamine, triethylene tetramine, tetraethylene pentamine, pentaethylene hexamine, propylene diamine, dipropylene triamine, tetrapropylene pentamine, butylene diamine and the like including mixtures thereof. The more preferred alkylene polyamines are the polyethylene polyamines especially those in which n is an integer of 1–6 and most preferably mixtures of such polyethylene polyamines in which n has an average value of 2–4.

The second is a monounsaturated aliphatic monocarboxylic acid. Although such acids containing about 12–24 carbons have some utility, it has been found that superior results are achieved using 18 carbon acids or mixtures of acids mainly composed of $C_{18}$ acids, especially oleic acid, or commercial products high in oleic acid content such as tall oil fatty acids. These acids can also be used in the form of their lower alkyl esters (e.g. methyl, ethyl, propyl, butyl) in which case the alcohol is displaced and distilled out during reaction.

The third reactant which is optional is an alkenyl succinic acid or anhydride, preferably an anhydride. These are well known compounds and can be made by heating a mixture of maleic anhydride and 1-olefin. The alkenyl group can vary over a wide range, for example, from 8–30 carbon atoms. Examples of these are octenyl, decenyl, dodecenyl, tetradecenyl, hexadecenyl, octadecenyl, eicosenyl, docosenyl, tetracosenyl, triacoulenyl and the like. More preferably, the alkenyl substituent contain about 10–14 carbon atoms. The alkenyl succinic reactant can also be used in the form of its lower alkyl ester but this is not the preferred mode.

The B component is made by reacting the above reactants in the ratio of one mole of polyalkylene polyamine: 0.1 to 5 moles of monounsaturated aliphatic monocarboxylic acid: 0 to 4 moles of alkenyl succinic anhydride; preferably the alkenyl succinic anhydride is used at a mole ratio of 0.5 to 3.5.

The reactants can be mixed altogether to provide a product formed in a single stage.

A preferred method of making the (B) component is in a first stage to react the monounsaturated aliphatic monocarboxylic acid with the polyalkylene polyamine; this reaction may preferably be carried out in an inert solvent such as hexane, benzene, xylene and the like at an elevated temperature. On completion of the first stage reaction, any remaining solvent is removed and the resultant product is a substance useful as the B component. In a more preferred method, the first stage product is then further reacted in a second stage with the alkenyl succinic anhydride; this second stage reaction may be carried out in another or the same inert solvent, preferably in mineral oil, to yield a solution of a further product useful as the B component.

The reaction temperature in making the B component can vary over a wide range. A useful range is about 40° to 200° C. More preferably, the reaction temperature in the first stage is high enough to distill out any water or alcohol displaced in the reaction. Thus, a more preferred range in the first stage is 100° to 190° C.

One way of forming component B is as follows: in a first stage react 1 mole of triethylene tetramine with between 1 and 2 moles of commercial oleic acid in hexane at between 100° and 160° C. to form primarily the amide. The water formed during the reaction is continually removed together with the hexane. On completion of the reaction, the product is cooled and reacted in a second stage with between 1.5 and 3 moles, of alkenyl succinic anhydride at between 75° and 100° C. and at less than 150 mm Hg pressure for at least 1 hour; this second stage is preferably carried out using between 25 and 75 percent by weight of mineral oil as solvent.

A preferred method of forming the fuel compositions is to formulate the co-additives as a concentrate and then simply add the proper amount of the concentrate to the alcohol-type motor fuel. The concentrate comprises a suitable inert solvent such as alcohols, ethers, esters, aromatic hydrocarbons and the like, and most preferably, aromatic hydrocarbons, such as toluene, xylene and the like, containing about 1 to 50 weight percent of the additive combination. The two active components, A & B, are preferably present in the ratios of between 1 part by weight of A to 10 parts by weight of B and 10 parts by weight of A to 1 part by weight of B. More preferably they are present in the ratios of between 1 part of A to 5 parts of B and 5 parts of A to 1 part of B.

Of course, it will be realized that any excess amine function and carboxylic acid function in the additive combination will probably exist as an amine salt. This is not detrimental and is considered as part of the invention as long as any such salt results from mixing the A and B components or from adding the A and B components to the fuel. Optionally, a mixture of the additives may be in a refluxing solvent with the elimination of water so as to form a reaction product.

To demonstrate the excellent corrosion inhibiting properties of the additive combination, tests were conducted using metal coupons cleaned with carborundum 40, washed with petroleum ether and finally dried in an oven at 40° C. for 10 minutes. The coupons were then weighed and immersed in 130 g of fuel in a sealed bottle for a specified period and at a specified temperature; tests in which the coupons were only semisubmersed were also carried out.

At the end of the test period, the coupons were removed from the fuel; after loose deposits were removed with a light brush, the coupons were washed and dried as at the start of the test and were then reweighed. Any change in coupon weight was recorded. The corrosion was characterized by two modes, either weight loss by loss of metal or weight gain due to deposition of corrosion products, in the tests carried out below, visual examination of the coupons after test indicated that the two modes were mutually exclusive.

The tests were carried out using as component A a polymer of a $C_{18}$ polyunsaturated aliphatic monocarboxylic acid which essentially comprised a trimer of linoleic acid and as component B, either component B1, a two stage reaction product of triethylene tetramine with oleic acid and $C_{12}$ alkenyl succinic anhydride or component B2, a one stage reaction product of triethylene tetramine with oleic acid containing 6.0% nitrogen and having an acid value of 265 mg KOH/g (IP1 method). Because the second stage of the two stage reaction was carried out in mineral oil, component B1 was made as a 50% concentrate in mineral oil, which concentrate contained 2.5 percent nitrogen and had an acid value of 56 mg KOH/g (IP1 method). The components were mixed together and added to the fuel as a concentrate in xylene.

A series of tests were carried out lasting 2 weeks at 40° C. and using Fuel No. 1, comprising methanol containing 100 p.p.m. formic acid and 10 p.p.m. methyl formate. The results of these tests which are set out in Table 1 demonstrate the excellent anticorrosion properties of a fuel containing an additive combination of the invention. Further tests were carried out lasting 6 weeks at ambient temperature and using three different fuels, as follows:

Fuel No. 2—15 wt percent methanol in gasoline containing 0.1 wt percent water.

Fuel No. 3—15 wt percent methanol in gasoline.

Fuel No. 4—methanol containing 0.1 wt percent water.

The results of these further tests are set out in Table 2 and further demonstrate the effectiveness of the additive combination of the invention in combatting corrosion.

TABLE 1

| Coupons Submersed/ Semisubmersed | Component A Concn. p.p.m. in fuel | Component B product | Component B Concn. p.p.m. in fuel | Additive Concentrate % Additive | Coupon Weight Change mg. Copper | Lead | Brass | Aluminium | Zinc |
|---|---|---|---|---|---|---|---|---|---|
| Submersed | 30 | B1 | 0 | 10 | +0.3 | −454 | −6.8 | −1.1 | −7.8 |
| Submersed | 0 | B1 | 15 | 10 | −5.0 | −550 | −4.1 | +1.1 | −6.6 |
| Submersed | 21.4 | B1 | 4.3 | 14 | +0.9 | −351 | −0.6 | −1.2 | −0.2 |
| Semisubmersed | 0 | — | 0 | — | +4.1 | −351 | +1.7 | +2.9 | −3.3 |
| Semisubmersed | 21.4 | B1 | 4.3 | 14 | −2.0 | −255 | −0.9 | −0.9 | −1.8 |
| Submersed | 2.9* | B1 | 3.5* | 14 | −2.1 | −459 | −2.1 | +0.1 | — |
| Submersed | 2.9* | B2 | 7.1* | 14 | −2.4 | −405 | −2.0 | +0.9 | — |
| Submersed | 0 | — | 0 | — | +17.3 | −432 | +5.5 | −0.7 | — |

Footnote* For these two tests the mixing of components A & B took place in refluxing xylene in such a manner that a reaction took place.

TABLE 2

| Fuel | Additive A1 Concn. p.p.m. in fuel | Additive B1 Concn. p.p.m. in fuel | Additive Concentrate % Additive | Coupon Weight Change mg. Copper | Lead | Semisubmersed Lead | Brass | Aluminium | Zinc |
|---|---|---|---|---|---|---|---|---|---|
| 2 | 2.9 | 3.5 | 14 | — | — | — | −0.1 | +0.3 | −0.1 |
| 2 | 0 | 0 | — | — | — | — | +0.8 | +0.5 | −0.9 |
| 3 | 2.9 | 3.5 | 14 | +0.7 | −0.2 | +0.3 | 0.0 | +0.2 | 0.0 |
| 3 | 0 | 0 | — | −0.8 | +0.1 | −5.0 | −0.5 | +0.3 | −0.2 |
| 4 | 2.9 | 3.5 | 14 | −1.6 | −191 | — | 0 | — | — |
| 4 | 0 | 0 | — | +0.4 | −408 | — | −1.0 | — | — |

We claim:

1. A liquid fuel adapted for use in an internal combustion engine said fuel comprising from 5 to 100 weight percent of one or more alcohols from 0 to 95 weight percent gasoline and a corrosion inhibiting amount of a combination of (A) a polymer of one or more $C_{16}$ to $C_{18}$ polyunsaturated aliphatic monocarboxylic acids and (B) a reaction product of (i) about one mole part of one or more polyalkylene polyamines having the formula $H_2N\text{-}(\text{-}RNH)_n\text{-}H$ wherein n is an integer from 1 to about 8 and R is a divalent hydrocarbon group containing 2 to 4 carbon atoms, (ii) about 0.5 to 5 mole parts of one or more $C_{10}$ to $C_{20}$ monounsaturated aliphatic monocarboxylic acids or lower alkylesters thereof and (iii) 0 to about 4 mole parts of an alkenyl succinic anhydride wherein the alkenyl group contains about 8 to 30 carbon atoms.

2. A liquid fuel as claimed in claim 1 wherein in component (B) of the combination reactant (ii) is a mixture of the said polyalkylene polyamines such that the average value of n is from 2 to 5.

3. A liquid fuel as claimed in claim 1 or claim 2 wherein component (A) is a polymer of one or more $C_{18}$ polyunsaturated aliphatic monocarboxylic acids.

4. A liquid fuel as claimed in claim 1 wherein said polymer consists mainly of dimers or trimers of the polyunsaturated aliphatic monocarboxylic acid or acids, or mixtures thereof.

5. A liquid fuel as claimed in claim 1 wherein the aliphatic monocarboxylic acid used in producing component (B) is $C_{18}$ aliphatic monocarboxylic acid.

6. A liquid fuel as claimed in claim 5 wherein said polyunsaturated aliphatic monocarboxylic acid is linoleic acid and said monounsaturated aliphatic acid is oleic acid or tall oil fatty acid.

7. A liquid fuel as claimed in claim 1 wherein component (B) of the said combination is a reaction product of (i), (ii) and from 0.5 to 3.5 mole parts of the alkenyl succinic acid.

8. A liquid fuel as claimed in claim 7 wherein said alkenyl succinic anhydride used in preparing component (b) is a $C_{10\text{-}14}$ alkenyl substituted succinic anhydride.

9. A liquid fuel as claimed in claim 8 wherein said alkenyl succinic anhydride used in preparing component (B) is a $C_{12}$ alkenyl substituted succinic anhydride.

10. A liquid fuel as claimed in claim 1 wherein said polyalkylene polyamine used in preparing component (B) is a polyethylene polyamine.

11. A liquid fuel as claimed in claim 7 wherein component (B) is prepared by reacting in a first stage at a temperature high enough to displace water (i) about 1 mole part of the polyalkylene polyamine and (ii) about 0.5 to 5 mole parts of the monounsaturated aliphatic monocarboxylic acid or lower alkylester thereof to form an intermediate and then in a second stage reaction said intermediate with (iii) about 0.5 to 3.5 mole parts of said alkenyl succinic anhydride.

12. A corrosion inhibitor concentrate comprising an inert solvent containing 1 to 50 wt percent of a combination of (A) a polymer of one or more $C_{16}$ to $C_{18}$ polyunsaturated aliphatic monocarboxylic acids and (B) a reaction product of (i) about one mole part of one or more polyalkylene polyamines having the formula $N_2N\text{-}(\text{-}R\text{—}NH)_n\text{-}H$ wherein n is an integer from 1 to 8 and R is a divalent hydrocarbon group containing 2 to 4 carbon atoms, (ii) about 0.5 to 5 mole parts of one or more $C_{10}$ to $C_{20}$ monounsaturated aliphatic monocarboxylic acids or lower alkyl esters thereof and (iii) 0 to about 4 mole parts of an alkenyl succinic anhydride wherein the alkenyl group contains about 8 to 30 carbon atoms, the weight ratio of A:B being from 1:10 to 10:1.

13. A concentrate as claimed in claim 12 wherein component (A) is a polymer of one or more $C_{18}$ polyunsaturated aliphatic monocarboxylic acids.

14. A concentrate as claimed in claim 12 or claim 13 wherein said polymer consists mainly of dimers or trimers of polyunsaturated aliphatic monocarboxylic and or acids or mixtures thereof.

15. A concentrate as claimed in claim 12 wherein the aliphatic monocarboxylic acid used in producing component (B) is $C_{18}$ aliphatic monocarboxylic acid.

16. A concentrate as claimed in claim 15 wherein said polyunsaturated aliphatic monocarboxylic acid is linoleic acid and said monounsaturated aliphatic acid is oleic acid or tall oil acids.

17. A concentrate as claimed in claim 12 wherein component (B) of the combination is a reaction product of (i), (ii) and 0.5 to 3.5 mole parts of a $C_{10\text{-}14}$ alkenyl substituted succinic anhydride.

18. A concentrate as claimed in claim 12 wherein said polyalkylene polyamine is a polyethylene polyamine.

* * * * *